US006431545B1

(12) United States Patent
Kuhne

(10) Patent No.: US 6,431,545 B1
(45) Date of Patent: Aug. 13, 2002

(54) BOARD GAME WITH NOVEL FORMAT

(76) Inventor: Scott A. Kuhne, 3860 Comstock La., Plymouth, MN (US) 55446

( * ) Notice: Subject to any disclaimer, the term of this patent is extended or adjusted under 35 U.S.C. 154(b) by 0 days.

(21) Appl. No.: 09/695,674

(22) Filed: Oct. 24, 2000

(51) Int. Cl.[7] ..... A63F 3/00

(52) U.S. Cl. ..... 273/272; 273/430

(58) Field of Search ..... 273/272, 429, 273/430, 431, 432

(56) References Cited

U.S. PATENT DOCUMENTS

| | | | | |
|---|---|---|---|---|
| 3,606,336 | A | | 9/1971 | Krause |
| 4,089,527 | A | | 5/1978 | Roth |
| 4,625,970 | A | | 12/1986 | Childs et al. |
| 4,666,161 | A | | 5/1987 | Elesie et al. |
| 4,854,594 | A | | 8/1989 | Eaton |
| 4,884,815 | A | | 12/1989 | Glenn |
| 4,911,452 | A | | 3/1990 | Marchese, Jr. |
| 4,941,668 | A | | 7/1990 | Mobrem |
| 4,955,614 | A | | 9/1990 | Buda |
| 4,998,735 | A | * | 3/1991 | Blackwell |
| 5,014,996 | A | | 5/1991 | Von Braunhut |
| 5,042,816 | A | | 8/1991 | Davis et al. |
| 5,054,775 | A | | 10/1991 | Banks et al. |
| 5,094,465 | A | * | 3/1992 | Dawson |
| 5,213,333 | A | | 5/1993 | Petrovich et al. |
| 5,288,075 | A | * | 2/1994 | Kelley |
| 5,388,836 | A | | 2/1995 | Foti |
| 5,403,014 | A | * | 4/1995 | Anema et al. |
| 5,454,569 | A | | 10/1995 | Walker |
| 5,660,389 | A | | 8/1997 | Freda, III |
| 5,704,611 | A | | 1/1998 | Pierce |
| 5,735,523 | A | | 4/1998 | Fioriglio |
| 5,758,877 | A | | 6/1998 | Liddell |
| 5,820,125 | A | * | 10/1998 | Olsen |
| 5,899,456 | A | | 5/1999 | Weinstock et al. |
| 5,906,371 | A | | 5/1999 | Peterson |
| 5,927,987 | A | * | 7/1999 | Berman |
| 6,012,721 | A | | 1/2000 | Harnish |
| 6,070,874 | A | | 6/2000 | Ivers |
| 6,095,522 | A | | 8/2000 | Spell et al. |

* cited by examiner

*Primary Examiner*—William M. Pierce
(74) *Attorney, Agent, or Firm*—Mark A. Litmar & Assoc. P.A.

(57) ABSTRACT

A board game and a method of playing a question and answer game on a playing board by a plurality of players according to the present invention may comprise steps of providing each player or each team of players with a gaming piece, the gaming piece to be used on the playing board with a starting position and a finish position; requiring the player or team of players to answer questions correctly before being allowed to move along the playing board; the questions being provided in written form with optional clues being provided on the cards to assist the player or team of players to answer the questions; after answering a question correctly, the player or team of player being allowed to move a distance along the board, the distance the player or team of players is allowed to move being potentially increased when fewer clues are provided to the player or team of players as compared to the distance that the player or team of players is allowed to move decreased when more clues are provided to the player or team of players. The method may be practiced where answers to the questions in any step, and especially where multiple questions are asked, the questions must be answered within a specific time frame. The method may be practiced where multiple questions are asked and wherein more than half of the questions must be answered to achieve a positive game response, and the more than half, for example, may be selected from the group consisting of two-out-of-three and three-out-of-five. The playing board may be provided with short-cuts that enable a player or team of players to move further along a path of travel between the starting point and the finishing point when a player or team of players lands on a position accessing the short-cut; the player or team of players being allowed to use the short-cut only when a number of questions from cards are asked to the player or team of players on the position accessing the short-cut, and the player or team of players correctly answers more than half of the questions from cards that were asked.

10 Claims, 3 Drawing Sheets

PCMCIA

Question

*Category*

Computer

*Hint*

Laptop Cards Group

*Answer*

Personal Computer Memory Card International Association

Fig. 2

Provide each player or each team of players with a gaming piece, the gaming piece to be used on the playing board with a starting position and a finish position;

Require the player or team of players to answer questions correctly before being allowed to move along the playing board, the questions being provided in written form with optional clues on the cards to assist the player or team of players to answer the questions;

Providing short-cuts on the playing board that enable a player or team of players to move further along a path of travel between the starting point and the finishing point when a player or team of players lands on a position accessing the short-cut; and Allowing the player or team of players to use the short-cut only when a number of questions from cards are asked to the player or team of players on the position accessing the short-cut, and the player or team of players correctly answers more than half of the questions from cards that were asked.

Figure 3

BOARD GAME WITH NOVEL FORMAT

BACKGROUND OF THE INVENTION

1. Field of the Invention

The present invention relates to board games, board games where players or teams of players move from a starting position to a final winning position, and games where players advance by answering questions to allow them to progress around the game board. In particular, the invention relates to such board games with special features enabling faster movement on the board based on knowledge-based skills.

2. Background of the Invention

Games involving trivia are well known in the art. Typically, such games require a playing board on which the progress of all players is identified by tokens of varying types. Forward movement along the board is determined by a combination of dice rolls, spinners and correct answers to questions. Selection of the questions is totally at random. Players neither choose nor control the subject matter.

Additionally, these games do not include wagering. Questions are not defined as to difficulty. Only one individual at a time plays as others wait their turn. The winner is merely the player who navigates a series of blocks or hazards to a finish line.

One game in this genre is U.S. Pat. No. 5,054,775 (Banks et al.). In Banks, a player selects a question card. The question card has four questions and answers, each pertaining to four distinct categories. The player also selects a category card. The category card indicates which question should be asked from the question card. If the player answers correctly, another player rolls a pair of dice. The number rolled is added to the player's score. The winner is the player with the highest score.

Another prior art game is Trivial Pursuit®. Trivial Pursuit® involves players traveling around a board by rolling a die. Each space is associated with a particular category. For example, in the Silver Screen Edition®, the categories are settings, titles, off-screen, on-screen, production and portrayals. Upon landing on a space, a player is asked a question. If answered correctly, the player rolls again. There is only one headquarters space for each category. If a player lands on a headquarters space and answers a question correctly, the player receives a wedge. When a wedge is obtained for each category, the player must move to the center of the board and answer a question correctly to win.

A prior art trivia game involving money is the home version of the television show Jeopardy®. In Jeopardy®, players pose questions in response to an answer. The answers are divided among several categories. A player selects an answer based on a designated dollar value and the category. The first player to ring in may attempt to pose the correct question. If the player poses the correct question, the player wins the designated amount. If the player answers incorrectly, the player loses the designated amount and other players can ring in (signal) to answer the question. The winner is the player with the most money at the end of the game.

Word games provide amusement and education. Many of such games, for example, that disclosed in U.S. Pat. No. 4,854,594 to Eaton, employ a board wherein players move tokens about a board and answer trivia questions related to the space upon which player tokens land. Another game employing trivia questions is disclosed in U.S. Pat. No. 4,884,815 to Glenn, which game also employs decoding a number to letters that are rearranged by the players into words. Other games, such as U.S. Pat. No. 4,666,161, Elesie, et al., employ a track or pathway on a board and have players draw cards with words and definitions, and wherein players advance by knowing the correct definition of drawn words. In other word games, such as that game shown in U.S. Pat. No. 4,089,527, to Roth, a player advances by memorizing items on cards. Word puzzles are involved in the game of U.S. Pat. No. 4,941,668, to Mobrem, and U.S. Pat. No. 4,911,452 to Marchese requires players to name a series of words which fit within a particular category and start with particular letters. U.S. Pat. No. 4,955,614 to Buda involves guessing particular words by a process of selecting and eliminating letters contained in the word. U.S. Pat. No. 3,606,336 to Krause is directed to a word association game wherein the player builds words from lettered tiles obeying the rule that successive words start from the last letter of the prior word and have a length derived from chance.

U.S. Pat. No. 6,070,874 teaches a question and answer game with associated items is played by a plurality of players. The questions are divided into categories with a predetermined number of questions in each category. Each question has assigned odds. A responding player selects one of the categories. The responding player is advised of the odds of one of the questions within the selected category. Players make wagers based on whether the question will be answered correctly. After the responder answers, players gain or lose based on the question's odds and whether the responder's answer is correct.

U.S. Pat. No. 5,899,456 teaches a progressive trivia game for two or more participants having a playing board with a path made of a plurality of symbolic positions, a six sided die, a plurality of question and answer cards and a timer. A player rolls the die to move to a symbolic position. The symbolic position defines a category of trivia. The card provides elements of an answer. The player scores a greater number of points by providing an answer before (a) time runs out and (b) by providing the answer by knowing a lesser number of elements. The object of the game is to be the first to score a predetermined amount of points.

U.S. Pat. No. 5,735,522 describes a quote and year trivia question game including a game board, die, a plurality of game pieces and a plurality of cards. Each of the cards has a front face with a plurality of quotes and questions relating to various subjects printed thereon. On a rear face of each card is the origin and answer of the quote and questions, respectively. The game is played by each player rolling the dice and moving an associated game piece along the game board as governed by whether or not the player guesses the correct origin or answer.

Certain games are known to have an object of moving around a fixed path on a board, with the winner determined by being the first player to travel around the entire board. Within this broad class of games, there are some games that display short-cuts or penalty paths through the fixed path. Games such as "Chutes and Ladders®" and "Candyland®" exemplify this format. In both of these cases, the short-cut is achieved solely by the luck or chance of landing on the space defining access to the short-cut.

Other games have weighted difficulties and chances for larger moves on the playing board based upon the difficulty of questions. U.S. Pat. No. 5,660,389 discloses a history-based trivia game wherein the answers to all questions are given in the form of a calendar year. Game components include a game board, throwing die, game pieces, playing cards and bonus markers. The object of the game is to be the first player to advance a game piece across a calendar year imprinted on the playing board by correctly answering questions found on the playing cards. A player may advance his or her playing piece one day of the calendar year for each point earned by correctly answering a question. Questions of greater difficulty are awarded a greater number of points. A weighted scoring system allows players to earn partial credit as calculated by the total number of points possible for a correct response minus a pre-designated number of points depending on the degree of variation of the player's response from said correct answer.

The subject matter of games covers an extremely wide range of interests in the format of the game and the subject matter of the questions. For example, U.S. Pat. No. 5,213,333 describes a word association game wherein the players derive different but commonly known word sets from elements of a previous commonly known set including a die, a board, a plurality of preprinted cards, a "minute glass" timer, a plurality of pads and writing instruments, and game tokens for movement on the board. The board has a path of adjacent spaces, which path is arranged with the start space at the crossing. The spaces are color coded in one of six different colors. The preprinted cards each have a blind side and a face side. The latter has six different color-coded areas with a different word set in each. A word set is a common phrase (e.g. TIE CLASP) or single (e.g. BLACKJACK) which includes a plurality of different word elements (e.g. TIE, CLASP, BLACK, JACK). Each card has different word sets from the other cards with those of one color coding being of a different word sets from the other categories: PEOPLE, PLACES, TITLES, THINGS, GENERAL and SPORTS/GAMES. A player's turn includes throwing a die and drawing a card at random. The player's piece is moved the number of spaces on the die to a space whose color-code determines the category and thus the starting word set. The player must in a time period enter successive word sets on the score pad, each entry related to the previous word set by using one of its elements for points and/or movement of tokens. Players alternate turns until one reaches a set goal (e.g. 100 points).

Other areas of topics that have been used as the basis of questions include, for example, basketball (U.S. Pat. No. 6,012,721); stock car racing (U.S. Pat. No. 6,095,522); weight loss (U.S. Pat. No. 5,704,611); Afro-American topics (U.S. Pat. No. 5,454,569), international finance (U.S. Pat. No. 5,388,836); biblical questions (U.S. Pat. No. 5,042,816); politics (U.S. Pat. No. 4,625,970); and the like.

U.S. Pat. No. 5,906,371 lists, among many other topics, the use of common abbreviations and acronyms as the basis or topic area for questions in a board advancement game. U.S. Pat. No. 5,758,877 describes a category of initials and abbreviations as one of the topics for questions asked in a board advancement game. U.S. Pat. No. 5,014,996 describes the use of acronyms in creating a sentence.

Although many different types of games are available in the marketplace, consumers and game companies are always interested in playing or providing a new game with unusual features that increase the enjoyment of players.

SUMMARY OF THE INVENTION

A board game is described in which players advance around a board seeking to be the first to complete the designated path of travel. Among unique features provided in the play of the game are cards providing questions that need to be answered if the player is to advance, the player having the option of receiving up to three clues or hints in answering the questions. The use of clues diminishes the rewards (the number of spaces advanced) won by the player as he/she plays. Special short cuts across the board or across segments of the boards are provided, with a player having to answer a certain percentage of questions (with or without clues and with the possibility of the percentage being less than 100%) to be able to access a short cut path. Penalties may also provided where a player uses all allotted clues and cannot answer the question, as moving back a space. A preferred topic of use in the play of the game is acronyms, abbreviations, nicknames, and the like. Two dice may be used, where the dice have different sets of numbers on their faces. The two dice may be used together or separately, depending upon how many clues were used, to increase or decrease the number of spaces a player advances upon answering a question and accessing questions of different difficulties.

BRIEF DESCRIPTION OF THE FIGURES

FIG. 2 shows a flow diagram of a second method of the invention.

FIG. 3 shows a flow chart for steps in the play of the game of this invention.

DETAILED DESCRIPTION OF THE INVENTION

Figure 1:
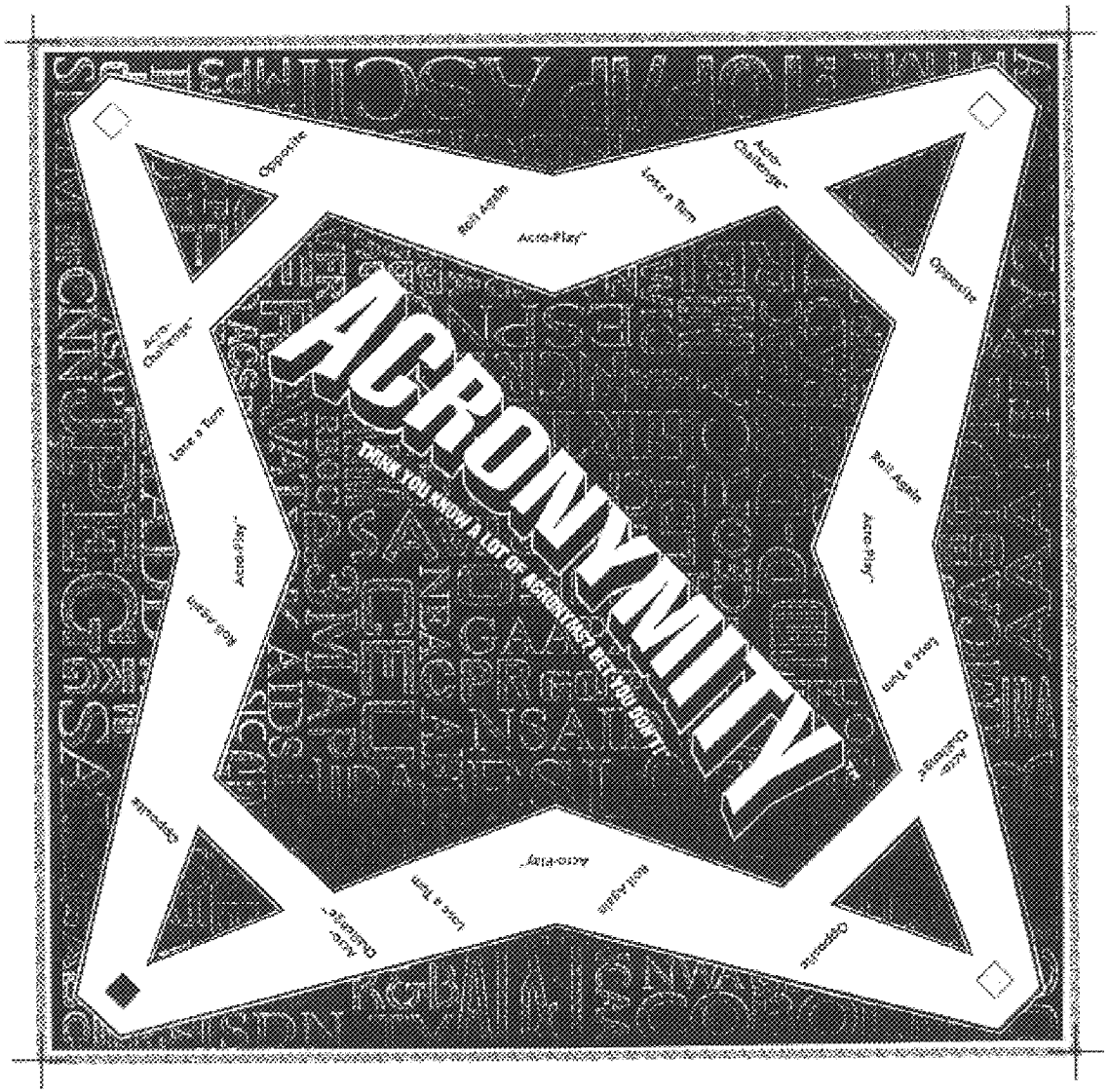
FIG. 1 shows a flow diagram of one method of the invention.

A board game and a method of playing a question and answer game on a playing board by a plurality of players according to the present invention may comprise the steps of:

a) providing each player or each team of players with a gaming piece, the gaming piece to be used on the playing board with a start position and a finish position;

b) requiring the player or team of players to answer questions correctly before being allowed to move along the playing board or being allowed to continue a turn;

c) the questions being provided in written form with optional clues being provided on the cards to assist the player or team of players to answer the questions;

d) after answering a question correctly, the player or team of player are allowed to move a distance along the board (or if they move before answering, retain that position on the board or retain that position on the board and continue their turn at play), the distance the player or team of players is allowed to move being potentially increased when fewer clues are provided to the player or team of players as compared to the distance that the player or team of players is allowed to move decreased when more clues are provided to the player or team of players. The method may be practiced where answers to the questions in any step, and especially where multiple questions are asked, the questions must be answered within a specific time frame. The method may be practiced where multiple questions are asked and wherein more than half of the questions must be answered to achieve a positive game response, and the more than half, for example, may be selected from the group consisting of two-out-of-three, three-out-of-four and three-out-of-five, including 100% of questions.

Another format of a game and method of playing a question and answer game on a playing board according to the present invention comprises the steps of:

a) providing each player or each team of players with a gaming piece, the gaming piece to be used on the playing board with a starting position and a finish position;

b) requiring the player or team of players to answer questions correctly before being allowed to move along the playing board;

c) the questions being provided in written form with optional clues being provided on the cards to assist the player or team of players to answer the questions;

d) the playing board being provided with short-cuts that enable a player or team of players to move further along a path of travel between the starting point and the finishing point when a player or team of players lands on a position accessing the short-cut; and e) the player or team of players being allowed to use the short-cut only when a number of questions from cards are asked to the player or team of players on the position accessing the short-cut, and the player or team of players correctly answers more than half of the questions from cards that were asked.

The method of the invention may be played where each player or team of players is provided with a specialty card that may be used by a player or team of player before a next player or next team of players begins play, the specialty card allowing the player or team of players to continue their play.

A preferred method of play involves the use of questions relating to acronyms or abbreviations and the clues provided include information with at least one area of information selected from the group consisting of a field of knowledge relating to the answer, a synonym for the answer, at least one word used in the acronym or abbreviation, and a general description of the answer. To provide different numbers of moves in the game, dependent upon how many clues or hints are given to a player or team of players, the playing board game may include a system of at least two different number generators, the system comprising at least two distinct number generators, a first number generator designed to, on average, produce numbers that are higher than the numbers provided a second number generator. The number generators may comprise at least two dice, the average value of numbers on a first die exceeding the average value of numbers on the second die, or the number generators comprise at least two spinners within a framework of numbers that are pointed to by the spinner, the average value of numbers on a first spinner exceeding the average value of numbers on the second spinner. A single spinner with two sets of differing values may also be used as the at least two number generators.

The method may have the playing board provided with short-cuts that enable a player or team of players to move further along a path of travel between the starting point and the finishing point when a player or team of players lands on a position accessing the short-cut; and the player or team of players being allowed to use the short-cut only when a number of questions from cards are asked to the player or team of players on the position accessing the short-cut, and the player or team of players correctly answers at least a fraction, at least half, or more than half of the questions from cards that were asked. The method may require that the answers to questions from cards are asked to the player or team of players on the position accessing the short-cut so that the answers must be answered within a specific time frame.

A board game is described where a player competes against other players to advance from a starting position to a finishing position by incremental moves around a board. Many options are available in the play of the game, and it should be understood that the description allows for the inclusion or exclusion of the various options in the design and play of inventive games within this invention.

Players begin at a starting position. This may be a common starting position, or each player may start at a unique compass position for each of the players. To begin play, the first moving player may be selected by any convenient means, such as selection of player colors by selection of individual player's movement or position pieces. For example, the colored movement pieces may be chosen to see which player moves first, dice may be rolled (with the highest or lowest player going first), a spinner/pointer may be used, and the like. The youngest player may also be chosen, with the order of play being clockwise or counter-clockwise from that point. To begin play, the player going first may either determine the possible number of spaces he/she will move or select a card from a question-card box or supply. It is preferred to have the player select the card first, for reasons that will be explained in greater detail later.

After the player selects the question card, another player reads the question (e.g., an acronym, such as MNDOT) to the player. The player may then choose to answer the question without any further information, or may elect to have a clue from the question card provided. It can be one aspect of the invention to have the potential amount of space advancement vary depending upon how many clues must be provided to enable the player to answer the question. For example, with the acronym "MNDOT" provided to the player, the player may elect to answer, pass, or have a first clue provided. If the player elects to answer the question and is wrong, the player may have play penalized by passing the play to the next player, moving back a space, or having to engage a space/movement indicator to move backwards. If the player requests a clue, a first clue is provided to the player. In this case, the first clue may be "Government Agency." The player may again elect to pass or answer the question or receive another clue. The level of penalty would preferably increase with a wrong answer or a pass after the first clue, although it could remain the same as with a pass or a wrong answer without a clue. This procedure may continue for up to three clues. The penalty would be most severe, or the only penalty (besides ending the player's turn) would be most severe for passing or giving a wrong answer after three clues. The penalty could include automatically losing the game or returning to the start position.

Similarly, the rewards for answering the questions with the fewest number of clues should also be enhanced. For example, where there are two dice, one dice may have numbers from 1–6 (a standard die) and the other may have numbers from only 1–3, 2–6, 3–6, 4–6 or the like. If the correct answer is given with no clues, the player may roll both of the dice to advance, or may roll only the large value (1–6 value) die. If one clue is given and the player correctly answers the question, the player may be allowed to roll only the large value die (or only the small value die). If two clues are given and the player gives a correct answer, the player may roll only the small value die or may be allowed to advance only a single space. If all three clues are given and the player gives a correct answer, the player may be allowed to continue his turn at play.

Another option is to begin play with a challenge series of questions. For example, the player first seeking to move from the start or base position must answer a number of questions or a proportion of questions within a given time frame. For example, to first move from the start position, the player must answer one or two card questions in less than thirty (30) seconds, with or without clues. This may be measured by a timing device such as an hourglass, windup clock, alarm, etc. Rather than having to answer all the questions correctly, Specific, Non-Limiting Example of Game Instructions Equipment Game Board 3 Die 4 Markers 1025 Acronymity™ Cards 4 Acro-Chance™ Cards Acronymity™ Card Sleeve 30 Second Timer Game Play Instructions Object of the Game Be the first player (or team of players) to successfully answer the Acronymity™ Cards and advance around the board back to your starting home position to complete a final "Acro-challenge™."

Some General Rules

- The youngest player should go first and then play proceeds clockwise.
- The person to the left of the player taking their turn assumes the role as "reader" and places the Acronymity™ Card into the Acronymity™ Card Sleeve and reads the Acronymity™ Card to the player.
- The reader can also read the category hint to the player if requested. (See "Advancing around the board" below)
- Each player or team can only play once per turn. Using the 3-chance play (See "Advancing around the board" below) if the player or team of players is unable to answer the Acronymity™ Card correctly during their turn, they must wait until their next turn and try again.
- Each player or team receives one Acro-Chance™ card per game.
- Teams of players may collaborate during play in an attempt to correctly answer the Acronymity™ Cards
- A player or team of players upon landing on the four "Acro-challenge™" squares on the board may choose to take the "Acro-challenge™ " or not take the "Acro-challenge™." If the player or team of players chooses to not to take the "Acro-challenge™" during their turn, regular play rules apply to the turn.
- If a player or team of players during the course of play land on a "Roll Again" square they must roll the same dice that was used to land on that square.
- Some Acronymity™ Cards may have more than one correct answer, but according to the rules of the game, there is only a single correct answer. It may therefore be desirable to request a clue where more than one appropriate answer is known to the player. Watch out, you could get fooled!

Start of the Game

To begin, each player or team of players puts their marker on one of the four "Start" positions. Only one marker may be placed on a start position. Each player or team of players must answer an Acronymity™ Card (without using the category hint) correctly before rolling the dice to move off the start position. If player answers the Acronymity™ Card correctly, they roll the 4-5-6 dice and move clockwise the number of spaces rolled. The player's turn ends and play proceeds to the next player. If player does not answer the Acronymity™ Card correctly, the turn ends and the player remains at the start position, and the next player in turn attempts to move off the start position.

Advancing Around the Board

Players must answer an Acronymity™ Card correctly each turn to roll a dice and advance around the board. Each player has three chances to per turn to proceed around the board. Play proceeds as follows:

- $1^{st}$ Chance—The person to the left of the player selects the next card in the deck inserting it into the Acronymity™ sleeve and then reads the Acronymity™ Card to the current player. If player or team answers the Acronymity™ card correctly without a $2^{nd}$ chance play, they may roll the 4-5-6 dice and move the number of spaces indicated and their turn ends. If the player incorrectly answers the Acronymity™ Card the turn ends, the player does not advance and play moves to the next player. If the player or team of players does not know the correct answer to the Acronymity™ Card the player prior to answering can choose to take a $2^{nd}$ chance play.
- $2^{nd}$ Chance—If player or team does not know the answer to the Acronymity™ Card, they may ask for a category hint. The reader reads the category hint from the card and the player then has 30 seconds to answer the Acronymity™ Card. If the player or team answers the Acronymity™ Card correctly, the player or team rolls the 1-2-3 dice and moves forward the corresponding number of spaces and the their turn ends. If the player or team of players does not know the correct answer to the Acronymity™ Card, the player or team of players prior to answering can decide between several options. They can choose to take the 3rd chance play, answer the question or stop and they do not advance and play moves to the next player. If the player incorrectly answers the Acronymity™ Card the turn ends, the player does not advance and play moves to the next player.
- $3^{rd}$ Chance—If the player or team chooses the $3^{rd}$ chance option the reader selects the next Acronymity™ Card in the deck. The player or team has only 30 seconds to answer correctly without any category hints. If they correctly answer the Acronymity™ Card, the player or team rolls the 1-2-3 dice, advancing them around the board and the turn ends. If they do not answer the Acronymity™ Card correctly, the player or team moves back one space and turn ends.

Acro-Chance™

Each player or team receives one and only one Acro-chance™ per game. The Acro-chance™ card may be used anytime during regular game play. The Acro-chance™ cannot be used on either the Acro-challenge™ spaces or the final Acro-challenge™. If a player or team is unsuccessful in either the $1^{st}$, $2^{nd}$ or $3^{rd}$ chance of regular play the player may choose to use the Acro-chance™ card. If the player or team decides they would like to use the Acro-chance™ card, they must shout out loud: "Acro-chance™" prior to the next players turn. The "Acro-chance™ is a one-shot opportunity. The player or team of players has only 30 seconds to answer correctly without any category hints.

Acro-Challenge™ Spaces

If the player or team lands on an "Acro-challenge™" space, the player or team must answer three out of five Acronymity™ Cards correctly within 30 seconds to advance across the bridge. The reader reads the cards to the player. The player may yell "Pass!" at any time to proceed to the next card in attempt to correctly answer three Acronymity™ Cards. Once the reader has read all five Acronymity™ Cards and the player or team has not yet correctly answered three Acronymity™ Cards during the 30 second Acro-challenge™, the reader may then give the provided category hints or create their own hints for the remaining unanswered cards to assist the player in winning the Acro-challenge™.

If the player correctly answers three of the five Acronymity™ Cards during the Acro-challenge™ the player or team moves across the bridge and the turn ends. If the player or team is not successful during the Acro-challenge™, the turn is over and the player or team cannot move across the bridge and must wait until next their next turn to proceed on the regular path under regular play rules.

Acro-Play™ Space

When a player lands on an Acro-Play™ space, a correct answer will advance the players game piece forward, and a wrong answer will retreat the player's game piece backwards on the board. The Acro-Play™ space may also require that all players at this point in the round answer a question with the Acro-Play™ space risk involved. The question may be the same question, with players writing down their answers or the players would get separate cards with different questions.

"Opposite" Play Position

When a player lands on an "Opposite" space, the question is asked by giving the answer and requesting the acronym generally used as the question. For example, if the acronym were "Pokemon™" and the answer was "Pocket Monster," when a player landed on the "Opposite" space and draws this card, the question asked will become "What is the acronym for Pocket Mosnter?" and the answer is Pokemon™.

Winning the Game

To win the game, the player must go all the way around the board and make it back to their home starting position. Upon reaching their home starting position during regular play, the player or team must wait until their next turn to answer a final "Acro-challenge™." The player must answer three out of five Acronymity™ Cards in less than 30 seconds, this time without any category hints. If they player or team is successful with the final Acro-challenge™, the player or team is declared the winner and game play ends. If they are unsuccessful in the final Acro-challenge™, the player or team turn ends, play moves to the next player, and they must wait until their next turn to attempt the final Acro-Challenge™ again.

Suggested Strategies

A Player or team of players may take a "category hint" or "third chance" play in order to roll the smaller dice for the opportunity to land on a particular square such as the "Acro-challenge™" or the "roll again" squares.

Alternative Acronymity™ Instructions

Equipment

Game Board

3 Dice

4 Markers

952 Acronymity™ Cards

8 Acro-Chance™ Cards

Acro-Sleeve™

30 Second Timer

Game Play Instructions

Object of the Game

To be the first player or team of players to successfully answer the Acronymity™ Cards and advance around the board clockwise returning to your starting home position and complete a final "Acro-Challenge™."

Setting Up the Game

Remove the game board, card boxes, 1-2-3 die, 4-5-6 die, 30 second timer, Acro-Sleeve™ and "Acro-Chance™" cards located in the front of the card boxes. To begin, each player or team of players receives one "Acro-Chance™" card and puts their chosen colored marker on the corresponding colored start position.

Some General Rules

The person to the left of the player or team taking their turn assumes the role as "reader" and places the Acronymity™ Card into the Acro-Sleeve™ and reads the Acronymity™ Card question and category to the player or team.

Each player or team can only play once per turn. (See "Advancing Around the Board" Next Section) If the player or team is unable to answer the Acronymity™ Card correctly during their turn, they must wait until their next turn and try again.

Teams of players may collaborate during play in an attempt to correctly answer the Acronymity™ Cards.

If a player or team during the course of play lands on a "Roll Again" square, they must roll the same die that was used to land on that square.

Some Acronymity™ Cards may have multiple Answers that may be appropriate. However, there is only one correct Answer per card. Use the Category as your clue, or take the Hint to be sure. Watch out, you could get fooled!

Some Acronymity™ Card Hints may include a word contained in the Answer.

Start of the Game

The youngest player goes first and then play proceeds clockwise. Each player (player) or team of players (team) must answer an Acronymity™ Card (without using a Hint) correctly before rolling the die to move off their home starting position.

If the player or team answers the Acronymity™ Card correctly, they roll the 4-5-6 die and move clockwise the number of spaces rolled. The player or team turn ends and play proceeds to the next player or team.

If the player or team does not answer the Acronymity™ Card correctly, the turn ends and the player or team remains at the start position, and the next player or team in turn attempts to move off the start position.

Winning the Game

To win the game, the player or team must go all the way around the board and return to their home starting position. Upon returning to their home starting position, the player or team must wait until their next turn and complete a final "Acro-Challenge™."

If the player or team is successful with the final "Acro-Challenge™," the player or team is declared the winner and game play ends.

If the player or team is unsuccessful in the final "Acro-Challenge™," the player or team turn ends, play moves to the next player or team, and they must wait until their next turn to attempt the final "Acro-Challenge™" again.

Advancing Around the Board

A player or team must answer an Acronymity™ Card correctly each turn to roll a die and advance around the board. Each player or team has three chances per turn to proceed around the board. If the player or team at anytime incorrectly answers the Acronymity™ Card the turn ends, the player or team does not advance, and play moves to the next player.

Play proceeds as follows:

1st Chance—The person to the left of the player or team selects the next card in the deck inserting it into the Acro-Sleeve™ and then reads the Acronymity™ Card Question and Category to the current player.

If the player or team does not know the correct Answer to the Acronymity™ Card, prior to answering they can choose to take the 2nd chance play.

If player or team answers the Acronymity™ Card correctly and they don't use the 2nd chance play, they may roll the 4-5-6 die and move the number of spaces indicated and their turn ends.

2nd Chance—If player or team does not know the Answer to the Acronymity™ Card, they may ask for the Hint provided on the card. The reader reads the Hint from the card and the player or team has 30 seconds to answer the Acronymity™ Card.

If the player or team answers the Acronymity™ Card correctly, the player or team rolls the 1-2-3 die and moves forward the corresponding number of spaces and their turn ends.

If the player or team does not know the correct Answer to the Acronymity™ Card, the player or team prior to answering, can decide between several options.

They can choose to take the 3rd chance play.

Try and guess the answer.

Stop and they do not advance and play moves to the next player or team.

3rd Chance—If the player or team chooses the 3rd chance option, the reader selects a new Acronymity™ Card from the deck inserting it into the Acro-Sleeve™ and then reads the Acronymity™ Card Question and Category to the current player or team. The player or team has only 30 seconds to answer correctly without any Hints.

If the player or team correctly answers the Acronymity™ Card, the player or team rolls the 1-2-3 die, advancing them around the board and their turn ends.

If the player or team does not answer the Acronymity™ Card correctly, the player or team moves back one space and their turn ends. If a player or team lands on a "Roll Again", "Lose a Turn", "Opposite", "Acro-Play™" or "Acro-Challenge™" space, that space does not count.

Acro-Chance™

Each player or team receives one, and only one "Acro-Chance™" per game. The "Acro-Chance™" may be used any time during regular game play. If a player or team is unsuccessful in either the 1st, 2nd or 3rd chance of regular play, the "Acro-Chance™" card resets the player or team's turn and gives them a new three-chance play. If the player or team decides they would like to use the "Acro-Chance™" card, they must shout out loud: "Acro-Chance™" prior to the next player or team's turn. The player or team surrenders their "Acro-Chance™" card and returns it to the game box and that player or team starts their turn over.

The "Acro-Chance™" cannot be used on a "Roll Again", "Lose a Turn", "Opposite", "Acro-Play™", "Acro-Challenge™" space or during the final "Acro-Challenge™."

Acro-Challenge™ Spaces

If the player or team lands on an "Acro-Challenge™" space, on their next turn the player or team must answer three-out-of-five Acronymity™ Cards correctly within 60 seconds (you'll need to turn the timer over a second time) to advance across the bridge. The player or team in an attempt to successfully complete the "Acro-Challenge™" may guess the answers as many times as they want without penalty during the "Acro-Challenge™."

If the player or team correctly answers three-out-of-five Acronymity™ Cards during the "Acro-Challenge™", the player or team rolls the 1-2-3 die and moves forward across the bridge the corresponding number of spaces and their turn ends.

If the player or team is not successful during the "Acro-Challenge™", the turn is over and the player or team cannot move across the bridge and must wait until their next turn to proceed on the regular path under normal game play rules.

Single Player Play—The reader reads the Acronymity™ Card Question and Category to the player. The player may pronounce out loud "pass" at any time to proceed to the next card in attempt to correctly answer three-out-of-five Acronymity™ Cards. Once the reader has read all five Acronymity™ Cards and the player has not yet correctly answered three-out-of-five Acronymity™ Cards, the reader may then give the provided Hints for the remaining unanswered cards to assist the player in winning the "Acro-Challenge™".

Team Play—The players on the team select someone from the team to assume the role as reader. The reader reads the Acronymity™ Card Question and Category to the team. The team may pronounce out loud "pass" at any time to proceed to the next card in attempt to correctly answer three-out-of-five Acronymity™ Cards. Once the reader has read all five Acronymity™ Cards and the team has not yet correctly answered three-out-of-five Acronymity™ Cards, the reader may then give the provided Hints for the remaining unanswered cards to assist the team in winning the "Acro-Challenge™."

Note: The reader has the option while reading the Hints to provide their own Hints to the Acronymity™ Card Question. The reader may not use any words contained in the Acronymity™ Card Answer that are not already provided in the Hint.

Acro-Play™ Spaces

When a player or team lands on an "Acro-Play™" space, every player or team has the opportunity to advance around the board or move backwards. The player or team that lands on the "Acro-Play™" space rolls the 1-2-3 die. The number rolled becomes the number of spaces each player or team is playing for during the "Acro-Play™" round. Every player or team draws a card. The "Acro-Play™" round begins with the player or team who landed on the "Acro-Play™" space reading the Acronymity™ Card Question and Category to the player or team to their left.

The player or team must correctly answer the Acronymity™ Card without any Hints to move forward around the board the number of spaces rolled. If the player or team answers incorrectly, the player or team must move backward the number of spaces rolled. If a player or team lands on a "Roll Again", "Lose a Turn", "Opposite", "Acro-Play™" or "Acro-Challenge™" space, that space does not count.

The "Acro-Play™" round continues clockwise until all players or teams have completed the round. Once the "Acro-Play™" round is complete the player or team who was next continues playing under normal game play.

Opposite Spaces

The "Opposite" space on the board reverses the way the Acronymity™ Card is answered. Instead of guessing the Acronymity™ Card Answer, when a player or team lands on the "Opposite" space, the player or team on their next turn must guess the Acronymity™ Card Question (on the top of the Acronymity™ Card) rather than guessing the Answer (on the bottom of the Acronymity™ Card.)

Play proceeds as follows:

1st Chance—The person to the left of the player selects the next card in the deck and reads the Category and Answer to the current player.

If the player or team does not know the correct Question to the Acronymity™ Card, prior to answering they can choose to take the 2nd chance play.

If player or team answers the Acronymity™ Card Question correctly and they don't use the 2nd chance play, they may roll the 4-5-6 die and move the number of spaces indicated and their turn ends.

2nd Chance—If player or team does not know the Question to the Acronymity™ Card, they may ask for the Hint provided on the card. The reader reads the Hint and the number of letters in the Acronym or Abbreviation from the Acronymity™ Card to the player or team. The player or team has 30 seconds to guess the Acronymity™ Card Question.

If the player or team answers the Acronymity™ Card Question correctly, the player or team rolls the 1-2-3 die and moves forward the corresponding number of spaces and their turn ends.

If the player or team incorrectly guesses the Acronymity™ Card Question the turn ends and play moves to the next player or team.

Suggested Strategies

A player or team may take a Hint or 3rd chance play in order to roll the smaller die for the opportunity to land on a particular square such as the "Acro-Challenge™", "Acro-Play™", "Opposite" or "Roll Again" squares.

Variations to Play

Use a regular 1–6 die instead of the 4-5-6 die. (one or both die included in game)

Attempt the "Acro-Challenge™" in 30 seconds instead of 60.

Do not use the 3rd chance play.

Play may thus proceed as follows:

1st Chance: The person to the left of the player or team selects the next card in the deck inserting it into the Acro-Sleeve™ and then reads the Acronymity™ Card Question and Category to the current player or team.

If the player or team does not know the correct answer to the Acronymity™ Card, prior to answering they can choose to take the 2nd chance play.

If player or team answers the Acronymity™ Card correctly and they don't use the 2nd chance play, they may roll the 4-5-6 die and move the number of spaces indicated and their turn ends.

2nd Chance: If player or team does not know the Answer to the Acronymity™ Card, they may ask for the Hint provided on the card. The reader reads the Hint from the card and the player or team has 30 seconds to answer the Acronymity™ Card.

If the player or team answers the Acronymity™ Card correctly, the player or team rolls the 1-2-3 die and moves forward the corresponding number of spaces and their turn ends.

If the player or team incorrectly guesses the Acronymity™ Card the turn ends, the player or team moves back one space and play moves to the next player or team.

At the final "Acro-Challenge™" instead of answering three-of-five Acronymity™ Cards, the player or team would have 60 seconds to make a complete sentence from three of the next five Acronymity Cards in the deck.

Example: You drive your 4WD truck to the ATM at your FDIC insured bank.

Each player or team receives two "Acro-Chance™" cards per game.

Each player or team must roll the exact number of spaces when returning to their starting home position.

What is claimed:

1. A method of playing a question and answer game on a playing board by a player or team of players comprising the steps of:

a) providing each player or each team of players with a gaming piece, the gaming piece to be used on the playing board with a starting position and a finish position;

b) requiring the player or team of players to answer questions correctly before being allowed to move along the playing board;

c) the questions being provided in written form with optional clues being provided on the cards to assist the player or team of players to answer the questions;

d) the playing board being provided with short-cuts that enable a player or team of players to move further along a path of travel between the starting point and the finishing point when a player or team of players lands on a position accessing the short-cut; and e) the player or team of players being allowed to use the short-cut only when a number of questions from cards are asked to the player or team of players on the position accessing the short-cut, and the player or team of players correctly answers more than half of the questions from cards that were asked.

2. The method of claim 1 wherein answers to questions in step e) must be answered within a specific time frame.

3. The method of claim 2 wherein more than half of the questions is two-out-of-three questions answered correctly and three-out-of-five questions answered correctly.

4. The method of claim 1 wherein more than half of the questions is selected from two-out-of-three questions answered correctly and three-out-of-five questions answered correctly.

5. The method of claim 1 wherein each player or team of players is provided with a specialty card that may be used by a player or team of player before a next player or next team of players begins play, the specialty card allowing the player or team of players to continue their play.

6. The method of claim 1 wherein answers to questions from cards are asked to the player or team of players on the position accessing the short-cut must be answered within a specific time frame.

7. The method of claim 1 wherein answering a question includes using multiple terms correctly within a sentence.

8. The method of claim 1 wherein a position on the game board requires that a card with a question thereon be selected, the answer provided, and a player must provide the question.

9. The method of claim 1 wherein a position on the game board requires that all players answer a question from a card, and that a correct answer advances the player a number of spaces and a wrong answer backspaces a player a number of spaces.

10. The method of claim 1 wherein after answering a question correctly, at least one die is tossed to determine the number of spaces to be moved by a gaming piece.

* * * * *